United States Patent [19]

Durkan, Jr.

[11] 4,438,603

[45] Mar. 27, 1984

[54] STADIUM SEATING

[76] Inventor: Martin J. Durkan, Jr., 17705 153rd Ave. SE., Renton, Wash. 98055

[21] Appl. No.: 391,553

[22] Filed: Jun. 24, 1982

[51] Int. Cl.[3] ..... E04H 3/12

[52] U.S. Cl. ..... 52/8; 297/232

[58] Field of Search ..... 52/8; 297/232, 444, 297/451, 450

[56] References Cited

U.S. PATENT DOCUMENTS

| | | | |
|---|---|---|---|
| 1,722,226 | 7/1929 | Kessler | 297/232 |
| 1,766,316 | 6/1930 | Vance | 52/8 |
| 2,193,339 | 3/1940 | McCann | 52/8 |
| 2,784,769 | 3/1957 | Fisher | 297/451 |
| 3,091,497 | 5/1963 | Houser | 297/450 |
| 3,124,390 | 3/1964 | Eames | 297/232 |

*Primary Examiner*—John E. Murtagh
*Assistant Examiner*—Kathryn L. Ford
*Attorney, Agent, or Firm*—Graybeal & Cullom

[57] ABSTRACT

Modular seating units (100) made from rotationally molded plastic which mount to a gradine (G) and join laterally, forming bench seating. Each seating unit (100) comprises two plastic pedestals, either of end configuration (12) or intermediate configuration (14), or a combination thereof, mounted by bracket means (24, 34) to a gradine (G) such as may be found in a stadium, and a plastic bench section (10), supported in a generally horizontal orientation between each pair of pedestals. The seat sections are spanned by reinforcing bars (32) which mount into channels (30) on the underside of the seat sections (10). Each seating unit (100) may include an independently mounted backrest unit (200), which comprises two mounting brackets (44) affixed to a gradine (G), or to reinforcing bars (32), supporting a rotationally molded plastic backrest section (38), by being affixed to a reinforcing bar (52) which mounts into a channel (50) in the back side of the backrest section (38). Backrest units (200) are also joined end-to-end to complement the seating units (100).

18 Claims, 6 Drawing Figures

STADIUM SEATING

DESCRIPTION

1. Field of the Invention

The present invention relates to mass seating and more particularly to plastic modular bench seating.

2. Background Art

In the past, mass bench seating has generally been made of wood, laminated material, or metal. Because of the escalating cost of these materials, and because of the advent of newer and better plastics, the industry has turned to plastic as a viable economical substitute. One patent disclosing the use of plastic bench seats is U.S. Pat. No. 3,213,507. These seats, however, are not interconnected and are mounted simply on vertical supports formed as part of the stadium gradine.

It has been the practice in the past to mount mass bench seats directly to stadium risers. End-to-end alignment of such seating often leaves gaps or uneven joints which are both uncomfortable to sit on and can pinch or tear clothing and skin. U.S. Pat. No. 4,126,354 depicts one solution to this problem by use of a track mounting means, placed along the top of risers and along which metal seat sections are slid to assure alignment.

Replacement and repair of traditional bench seating can be difficult and expensive, both because of the price of the materials involved, and because pieces are not readily interchangeable, leading to a high inventory of parts or special order situations. Also, in the past bench seating systems, once assembled, were considered permanent, and therefore were very difficult to disassemble for repair or replacement of component parts.

It is the principal object of this invention to provide plastic modular bench seating units which are comprised of a minimum number of molded plastic elements that assemble to form modular seating units and disassemble for replacement of broken or damaged elements. Such molded plastic pieces are relatively lightweight and easy to handle, yet strong, reducing the labor necessary for their installation and repair. Because of the elemental design and modular assembly of each seating unit, repair is simplified.

A further object is to cut the material and labor costs in providing and maintaining this improved seating. One means by which this objective is accomplished is that the seat sections are cross sectionally designed so that they can be cut to length in any one of several places. This allows the seat section to be cut to needed size at the installation site, thereby simplifying installation and reducing the inventory of seat sections necessary. It further allows the ends of the seat sections to be cut at other than right angles if desired, permitting the assembly to curve in accommodation with any given stadium contour. Wastage is minimized because remnants of one or more seat pan widths can always be used.

Rotationally molded plastic is both strong and durable. The strength of the seat sections is augmented by design, including both continuous and interrupted ribbing along their underside which increases their section modulus. Further, because the elements are made from rotationally molded plastic, preferably polyethylene, they can readily be molded to include added features such as fire retardant additives, anatomical contouring, colors on request, or curvature to fit a particular stadium.

Another purpose of this invention is to provide a bench seating arrangement which can be used both in stadia which have gradines of alternate risers and walkways built into them, and be affixed to free standing mounting blocks as well, such as would be appropriate for use at a park or at a bus stop.

Another object of this invention is to provide stadia bench seating which is mounted to pedestals, making the height of the seats independent of the height of the risers in a given stadium. The design of the pedestals requires that the underside of the upper back edge of the pedestal engage a horizontal or walkway surface for support, but the bottoms of the pedestals need not engage a horizontal or walkway surface. This feature allows one size of pedestal to fit risers of many different heights. It also makes easier the cleaning of debris from underneath pedestals whose bottoms are spaced substantially above the horizontal or walkway surface below them.

DISCLOSURE OF THE INVENTION

The present invention relates to a modular seating assembly constructed from rotational molded, hollow core plastic pieces which can quickly and conveniently be assembled together to form mass bench seating of any desired length. The modular seating system includes a plurality of integrally formed plastic pedestals which are attached in spaced array along a gradine, such as in a stadium. Between adjacent pedestals is extended a plastic seat section, with its ends interfitting into respectively congruent recesses in the upper portions of adjacent pedestals.

The pedestals, whose upper back edges rest on horizontal surfaces for support, but whose bottoms need not rest on a horizontal surface, are attached to the gradine by both vertical and horizontal mounting bracket means. These brackets are placed one on each side of intermediate pedestals, i.e. those with seat sections extending from both sides of them, but only on the inside of end pedestals, i.e. those pedestals which have seat sections extending only to one side of them, thus being the end of a row.

Vertical mounting brackets are of an angle-iron configuration, with one side affixed to the lower inside leg portion of a pedestal, and the other side affixed to the lower part of the vertical surface of the gradine. Horizontal mounting brackets are of a generally flat configuration with a turned-down portion on the front edge which fits into a groove in the front portion of the upper surface of the pedestal. When the turned-down edge is hooked into the groove, the body of the horizontal bracket lays flat against the upper portion of the pedestal, extending rearwardly. The back portion of the horizontal mounting brackets are an L-shape so that they extend downward past the back edge of the pedestal and then rearwardly, flush with the horizontal surface of the gradine. This back portion can thereby be mounted to the horizontal surface of the gradine.

To increase the structural rigidity and strength of the modular seating assembly, reinforcing bars are affixed in spaced array to the tops of the horizontal mounting brackets. These reinforcing bars fit into channels which run the length of the underside of the seat sections. When the seat sections are extended between adjacent pedestals, the end of the seat sections are supported by the pedestals and the reinforcing bars are captured in the channels on the underside of the seat section thus supporting and strengthening the unit.

This modular seating assembly may be assembled with or without independently affixed backrest sections. The backrest sections are made of rotationally molded plastic and supported by generally L-shaped bracket means. Extending the length of the back side of a backrest section is a channel into which fits a reinforcing bar. A bar is attached to each backrest section, and to each bar, near each of its end portions, is affixed a mounting bracket. These brackets extend downwardly and then forward, so that their forward extending portions run parallel with, and can be mounted to, the horizontal or walkway portion of a gradine. An alternative means of mounting the backrest section brackets supporting the backrest section, is to affix, such as by weldments, the forward extending portions of the mounting brackets to the underside of the seat section reinforcing bars, with the upwardly extending portions of the brackets being shortened and the forward extending sections being lengthened an appropriate extent to maintain the backrest sections at the desired position above and behind the seat sections.

The backrest sections are held in end-to-end alignment by backrest section connectors which have recesses into which interfit the adjacent ends of backrest sections, holding them in lateral alignment. Thus, backrest sections can be fitted end-to-end forming a length in complement with any length of seat sections created.

BEST MODE OF THE INVENTION

Figure 1:
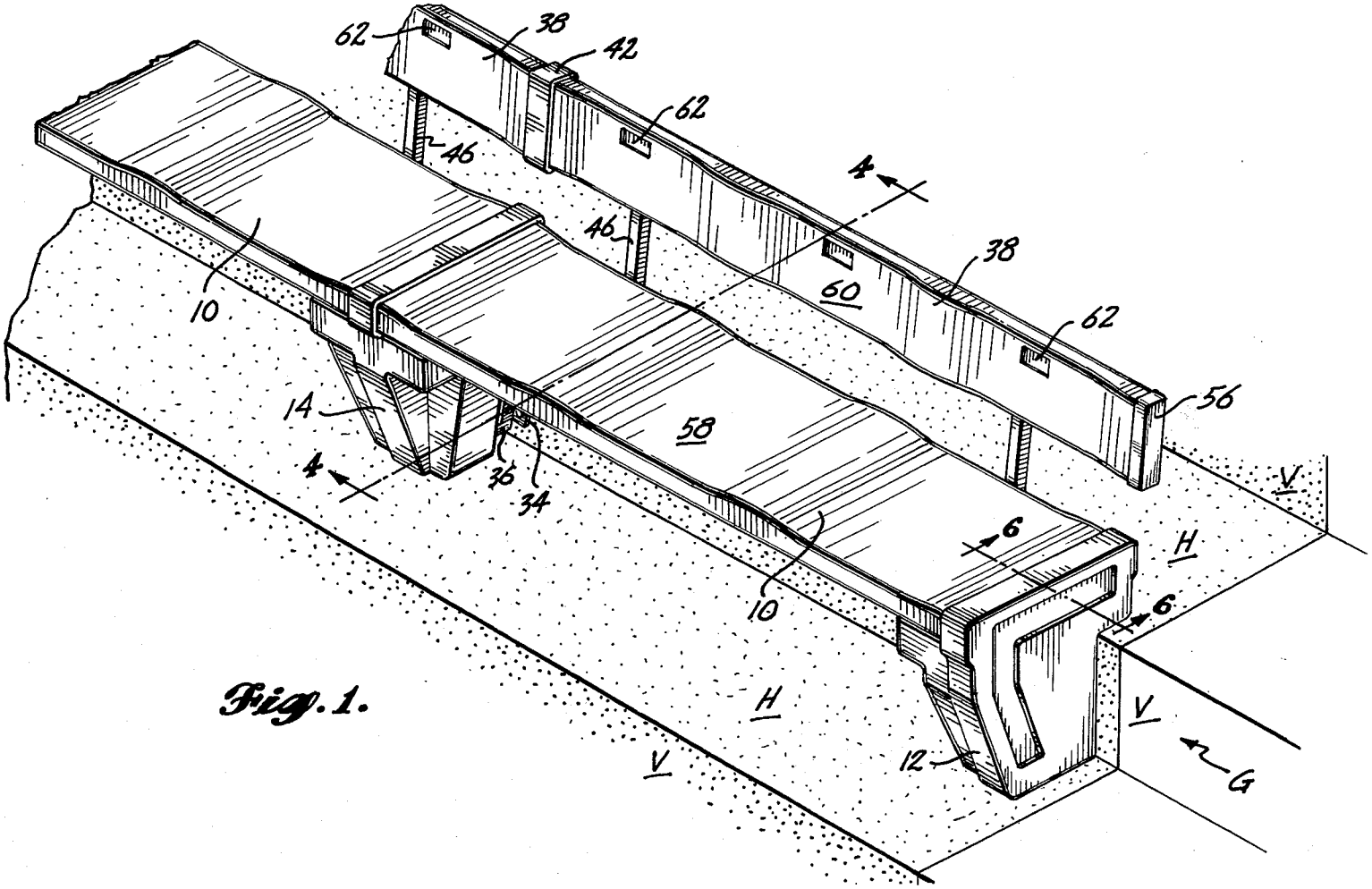
FIG. 1 is an isometric view, as taken from an upper, frontal aspect, of a portion of a modular assembly unit affixed to a riser in a stadium.

Referring initially to FIG. 1, a seating assembly 100 constructed according to the best mode of the present invention currently known to the applicant, comprises seat section 10 supported in a generally horizontal orientation by two pedestals. The two supporting pedestals may be either of the end pedestal 12 configuration, or the intermediate pedestal 14 configuration, or a combination of an end pedestal 12 and an intermediate pedestal 14, as shown. By selectively creating an array of two end pedestals 12 and with or without intermediate pedestals 14, with a seat section 10 supported between each two adjacent pedestals, a seating assembly of any desired length can be created.

Figure 2:
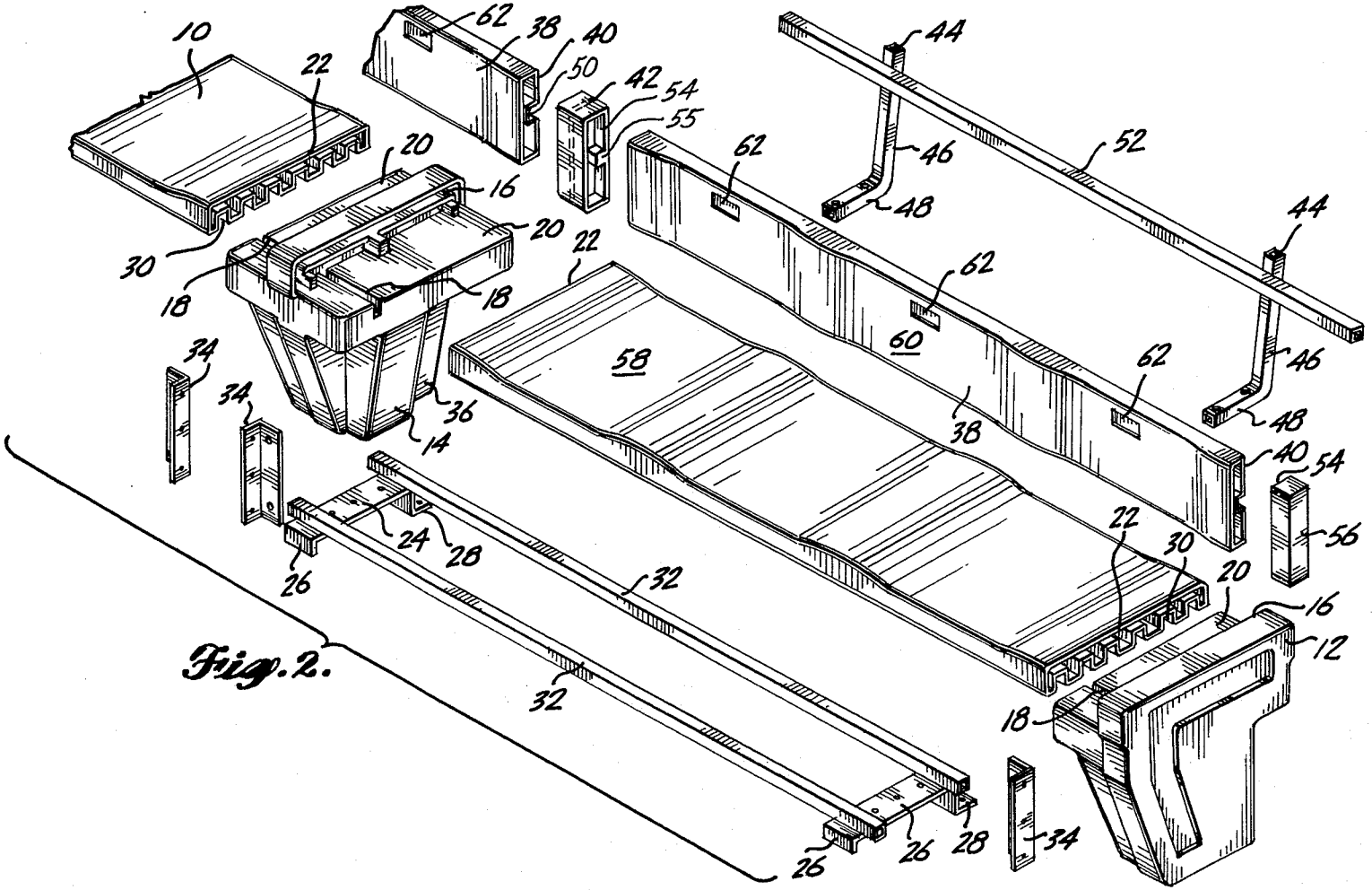
FIG. 2 is an exploded isometric view similar to FIG. 1, illustrating the components comprising the modular seating unit and its mounting means shown in FIG. 1.
Figure 6:
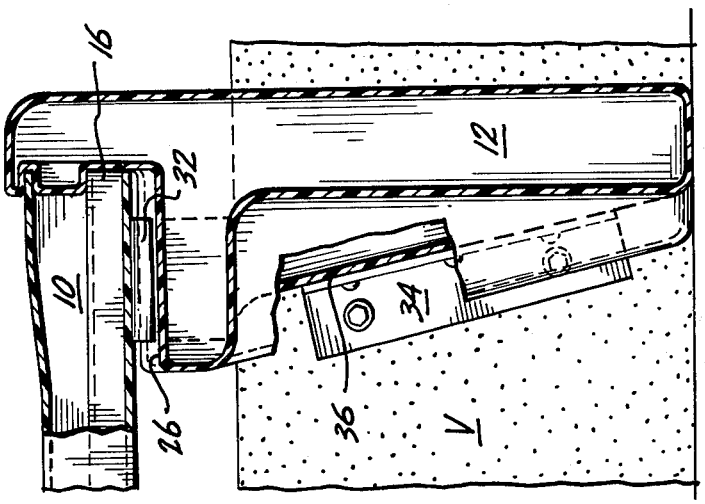
FIG. 6 is an enlarged cross-sectional view taken substantially along lines 6—6 of FIG. 1.

As can be best seen in FIGS. 2 and 6, end pedestal 12 comprises a congruent recess 16, located near the top on its inner side, a groove for a bracket means 18, and a shelf section 20. The outer side is more or less a flat, vertical surface, as shown. End pedestal 12 receives and supports only one end 22 of one seat section 10, on its inner side. On the other hand, intermediate pedestal 14 is designed to support the respective ends 22 of two end aligned seat sections 10. Located near the top on each side, it has a congruent recess 16, a horizontal bracket groove 18 and a self section 20. Each end 22 of a seat section 10 is fitted into a congruent recess 16 of a pedestal, and thereby the seat section 10 is held in horizontal orientation, supported by a shelf section 20 at both ends.

Referring to FIG. 2, end pedestal 12 and intermediate pedestal 14 are mounted in a substantially identical fashion to the horizontal surface H (walkway) of a gradine, by means of horizontal mounting brackets 24, the only difference being that intermediate pedestal 14 is fastened on both sides, whereas end pedestal 12 is fastened only on its inward side.

Referring to FIG. 2, the underside of seat section 10 contains a plurality of recessed channels 30. Reinforcing bars 32, of a size and length designed to fit recessed channels 30 of seat section 10, are welded to horizontal brackets 24 in such a spatial relation as to fit into recessed channels 30 on the underside of seat section 10. The recessed channels 30 on the underside of seat sections 10, as well as the interrupted ribbing found there serve the design function of strengthening seat sections 10 by increasing their section modulus.

Figure 4:
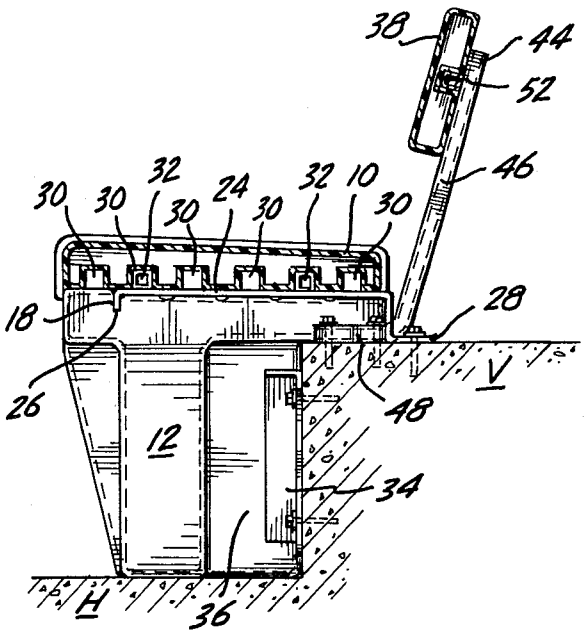
FIG. 4 is a side cross-sectional view taken substantially along lines 4—4 of FIG. 1.

The horizontal mounting brackets 24, with reinforcing bars 32 preaffixed to them, as by weldments, in the proper spaced array to fit into the recessed channels 30 of seat section 10, are mounted to the pedestals and the horizontal surface H of a gradine G in the following manner. The front portions of these horizontal mounting brackets 24 have a turned-down edge 26 which fits into a congruent groove 18 located on the front part of shelf surface edge 26 of an end pedestal 12 and an intermediate pedestal 14. With the turned-down front edge 26 hooked into groove 18, the horizontal mounting bracket 24 lays horizontally along shelf surface 20 (FIG. 4). The back edge 28 of the horizontal mounting bracket 24 extends downwardly and then rearwardly in an L-shape. When the horizontal mounting bracket 24 is in place with turned-down front edge 26 hooked into congruent groove 18 of a pedestal, the L-shape back edge 28 extends downwardly and rearwardly of the shelf surface 20 of the pedestal, thereby laying flat along the horizontal surface H of the gradine.

Seat section 10 is then mounted between adjacent pedestals by being placed on top of the welded reinforcing bars 32 and horizontal brackets 24 so that reinforcing bars 32 fit into the recessed channel 30 of seat section 10, fitting respectively the ends 22 of seat section 10 into the congruent recess 16 facing each other on the adjacent pedestals. The rear portion 28 of mounting bracket 24 can then be bolted or otherwise appropriately affixed to the horizontal surface H of the gradine, as best shown in FIG. 4.

Figure 3:
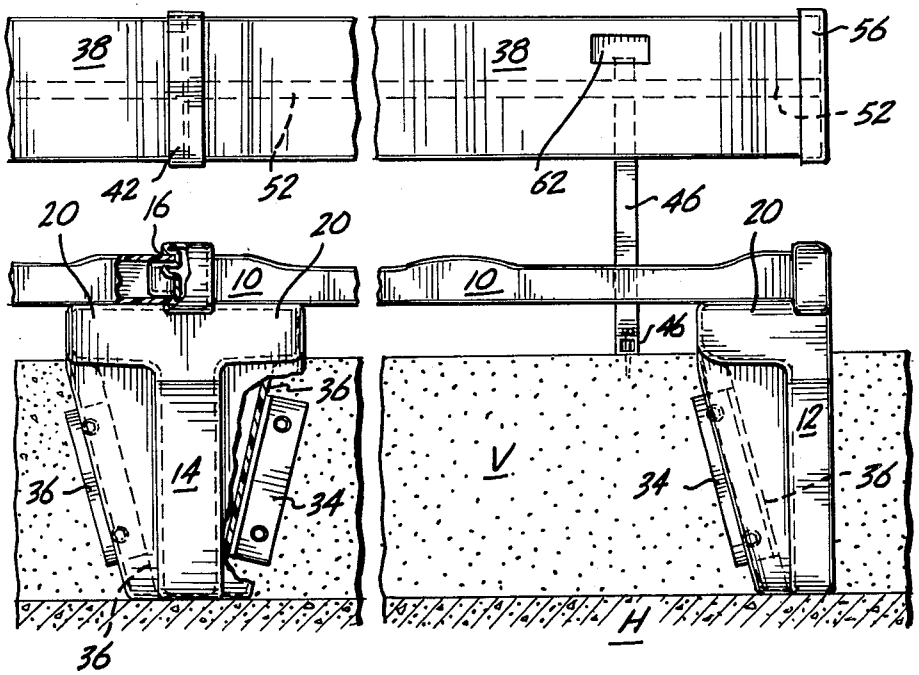
FIG. 3 is a frontal elevational view with parts of the pedestal cut away, further illustrating the mounting means.

Referring next to FIGS. 2, 3, 4 and 6, the pedestals are mounted to the vertical surface V (riser) of a gradine G in the following manner. End pedestals 12 and intermediate pedestals 14 are mounted to the vertical face V of a gradine in similar fashion, differing only in that end pedestal 12 has a single vertical mounting bracket 34 (mounted on its lower, rearward inner side) directly below its single shelf surface 20, whereas intermediate pedestal 14 is mounted to vertical surface V by means of two vertical brackets, one on each rearward lower side directly beneath each of its two shelf sections 20, as shown in FIG. 3.

Vertical mounting brackets 34, as best shown in FIG. 2, suitably comprise a right angle iron with one side permanently affixed, as by bolts, to the lower rearward vertical surface 36 of a pedestal. The other side of vertical mounting bracket 34 is then bolted or otherwise fastened to the vertical surface V of the gradine G.

Backrest unit 200 is mounted on the gradine independently of seating assembly 100, and seating assembly 100 can be installed with, or without, backrest unit 200 as desired.

Referring initially to FIG. 2, backreset unit 200 comprises backrest section 38, interconnected by backrest section connectors 42, and mounted in place by backrest mounting brackets 44.

Figure 5:
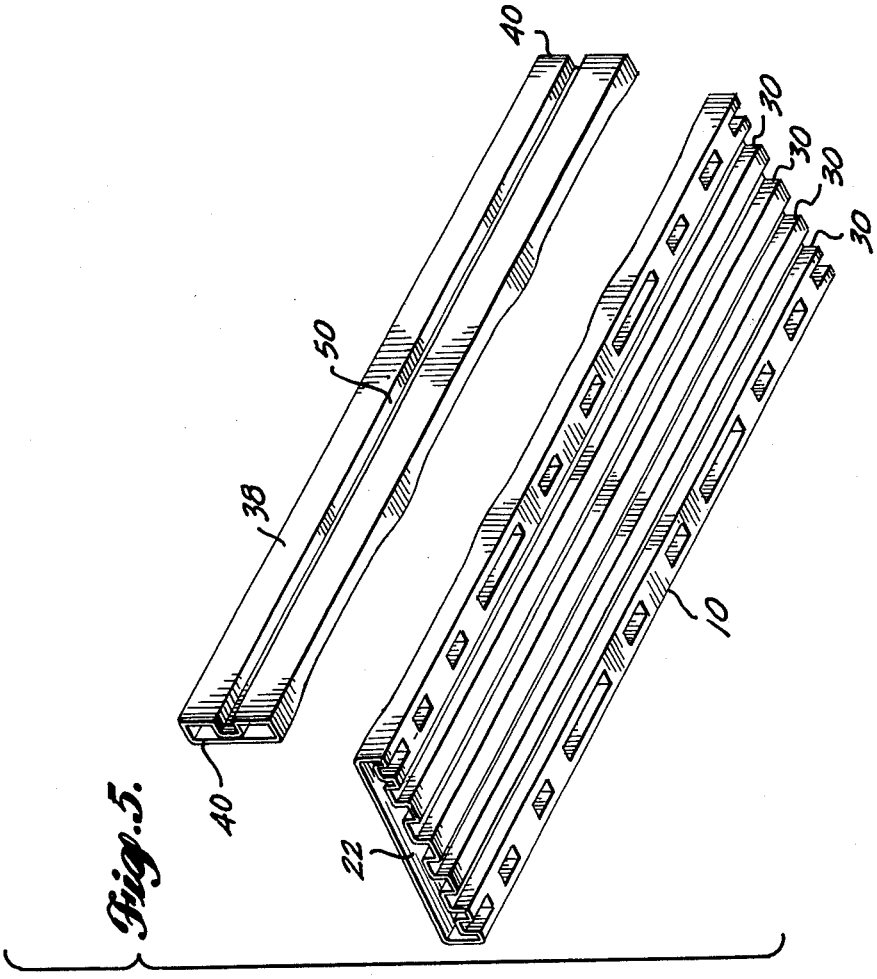
FIG. 5 is a fragmentary bottom isometric view, specifically illustrating the seat section and the back of the back rest section of the assembly.

As can best be seen in FIG. 5, running lengthwise of backrest section 38 on the rearward facing side is a recessed channel 50. Referring to FIG. 4, it can be seen that reinforcing bar 52 fits into recessed channel 50 in backrest section 38. Reinforcing bar 52 has welded or otherwise permanently affixed to it, near its end portions, two mounting brackets 44 as can best be seen in FIG. 2. Mounting brackets 44 are generally L-shaped, with their top portions affixed to reinforcing bar 52 and each with a central portion 46 extending downwardly and a bottom portion 48 extending forwardly so that when their bottom portions 48 are bolted or otherwise appropriately fastened to the horizontal surface H of a gradine G, the brackets 44 extend upwardly and the reinforcing bar 52 is firmly held above and generally parallel to the gradine's horizontal surface H. Reinforcing bar 52 is then inserted into and fastened as by bolting into recessed channel 50 of backrest section 38, thereby holding backrest section 38 above and slightly rearward of seating assembly 100.

An alternative means for fastening mounting brackets 44 supporting backrest section 38 as described above, is to weld or otherwise rigidly attach the top side of their forwardly extending bottom portions 48 to the underside of seat section reinforcing bars 32.

A series of backrest sections 38 are held in lateral alignment and made continuous by means of backrest section connectors 42. Backrest section connector 42 has on both ends integrally formed outer walls 54 and a plug portion 55 into which the end 40 of a backrest section 38 fits with plug portion 55 lodged in the end of a section slot 50. Backrest section connector 42 can accommodate an end 40 of a backrest section 38 on each end, thereby rigidly joining two ends 40 of adjacent backrest sections 38 to create backrest units 200. Where a backrest section 38 is to be placed behind an end pedestal 12, at the end of a row of seating, it can be capped with a backrest section end cap 56. Backrest section end caps 56 have an integrally formed groove 54 on only one end into which the end 40 of backrest section 38 fits. The other end of a backrest section end cap 56 is more or less a flat vertical surface, as shown in FIGS. 2 and 3.

Seat sections 10 and backrest sections 38 are cross sectionally designed so that when cut in any of several places along their length, an end cross sectional configuration 22 or 40 is obtained.

Seat sections 10, backrest sections 38, backrest section connectors 42 and end caps 56, and pedestals 12 and 14 are preferably made of thermally molded plastic, preferably polyethylene, by rotationally molding, a technique known per se, such as disclosed in Daloisio U.S. Pat. No. 4,280,640. When formed by rotational molding, seat sections 10 and backrest sections 38 readily can be anatomically contoured as shown at 58 and 60 of FIG. 2, or not, as desired, and made to any desired wall thickness, e.g. 1/5 to ⅓ inch, or 3 to 9 mm S.I. Another feature of backrest sections 38 easily formed by rotational molding is the formation of indentations 62 in spaced array along backrest section 38 corresponding with the anatomical contour 60 and the complementary anatomical contour 58 of seat section 10. These indentations 62 on the backrest section 50 can be used for seat identification by insertion of numbered or lettered placards or other suitable means.

Having thus described the invention and the manner in which it is to be performed, it is to be understood that certain changes or modifications may be made in the same from the exact form shown and described herein and which are within the scope of protection afforded by the appended claims.

What is claimed is:

1. In combination with a gradine comprising a generally vertical surface abutting a generally horizontal surface, a modular seating assembly comprising; a plurality of integrally formed plastic pedestals attached in spaced array along said gradine, and an integrally formed plastic seat section extending between adjacent pedestals, said seat section interfitting in respectively congruent recesses in the upper portions of said pedestals, and each pedestal being attached to said gradine by bracket means affixed both to the sides of said pedestals and to the generally vertical surface of said gradine, rearwardly of said pedestal.

2. In combination with a gradine comprising a generally vertical surface abutting a generally horizontal surface, a modular seating assembly comprising, a plurality of integrally formed plastic pedestals attached in spaced array along said gradine, and an integrally formed plastic seat section extending between adjacent pedestals, said seat section interfitting in respectively congruent recesses in the upper portions of said pedestals, and each pedestal being attached to said gradine by horizontally extending bracket means affixed to the top of a pedestal and to said gradine, forwardly engaging a slot in the upper surface of a pedestal and rearwardly affixed to the generally horizontal surface of a gradine rearwardly of said pedestal.

3. In combination with a gradine comprising abutting generally vertical and horizontal supporting surfaces, a modular seating assembly comprising elemental interfitting components including a plurality of integrally formed molded plastic pedestals attached in spaced array along said gradine, and an integrally formed molded plastic seat section extending between adjacent pedestals, the ends of said seat section interfitting in respectively congruent recesses in the upper portions of said pedestals, and bracket means rigidly affixing each pedestal to said vertical and horizontal supporting surfaces, the attachment of said pedestals to said supporting surfaces serving to maintain said seat section in interfitting engagement with said pedestals.

4. The combination of claim 3, wherein said seat section is formed with an essentially flat upper surface and with a plurality of recessed channels extending the length of the lower surface thereof, said seat section further including external metal reinforcing bar means supported by said bracket means and situated in a plurality of said channels, and extending substantially the length of said seat section and into interfitting engagement with the adjacent pedestals.

5. The combination of claim 3, wherein the attachment of each pedestal to said gradine comprises bracket means affixed both to the sides of said pedestals and to the generally vertical surface of said gradine, rearwardly of said pedestal.

6. The combination of claim 3, wherein the attachment of each pedestal to said gradine comprises generally horizontally extending bracket means affixed to the top of the pedestal and to the gradine, forwardly engaging a slot in the upper surface of the pedestal and rearwardly affixed to the generally horizontal surface of the gradine rearwaly of said pedestal.

7. The combination of claim 3, wherein said pedestals and seat section are formed by rotational molding.

8. The combination of claim 7, wherein said plastic pedestals and said seat section have wall thicknesses of about 1/5 to ⅓ inch.

9. The combination of claim 3, wherein said seat section is of substantially uniform cross section end to end, to enable the formation of at least one seat subsection by cross cutting said seat section.

10. The combination of claim 3 comprising several pedestals and seat sections arranged on a series of gradines, such as those of a stadium or the like, made up of a series of walkways and risers.

11. The combination of claim 4, wherein said seating assembly further comprises an integrally formed molded plastic backrest section, said backrest section configured in its rear surface to have a longitudinally extending recessed channel with a reinforcing bar in said recessed channel, the reinforcing bar and backrest section being rigidly supported above and behind said seat section by backrest section mounting bracket means attached to the gradine.

12. The combination of claim 11, wherein said backrest section mounting bracket means are attached to the gradine horizontal surface situated rearwardly of said seat section.

13. The combination of claim 12, wherein said pedestals, seat sections and backrest sections are formed by rotational molding.

14. The combination of claim 13, wherein said plastic pedestals, said seat section, and said backrest sections have wall thicknesses of about 1/5 to ⅓ inch.

15. The combination of claim 12, wherein said modular seating assembly comprises several backrest sections arranged end-to-end and interconnected by backrest section connectors in the form of integral molded plastic pieces with oppositely facing congruent recesses into which fit adjacent backrest section ends, thereby forming a contiguous backrest section array.

16. The combination of claim 15, wherein the end backrest section ends are each capped with an integrally molded plastic end cap with a congruent recess fitting onto the backrest section end.

17. In combination with a series of gradines each comprising a generally vertical surface abutting a generally horizontal surface, a modular seating assembly comprising a series of integrally formed molded plastic pedestals attached to said gradines in spaced array with end pedestals at the ends of such array and with at least one intermediate pedestal therebetween, integrally formed molded plastic seat sections each formed with an essentially flat upper surface and with a plurality of recesses extending the length of the lower surface thereof, said seat sections extending between the pedestals with the ends thereof interfitting in respectively congruent recesses in the upper portions of said pedestals, said end pedestals each supporting the end of one seat section in a single recess and said intermediate pedestals each supporting the ends of two adjacent seat sections in opposing recesses; attachment means rigidly affixing each pedestal to a gradine, said attachment means also serving to maintain said seat sections in interfitting engagement with said pedestals, said attachment means each comprising metal bracket means affixed both to the sides of said pedestals and to the generally vertical surface of the gradine situated rearwardly of said pedestals, and said attachment means further comprising horizontally extending metal bracket means each affixed to the top of a pedestal and to the gradine, forwardly engaging a slot in the upper surface of a pedestal and rearwardly affixed to the generally horizontal surface of the gradine rearwardly of said pedestals; metal seat section reinforcing bar means extending throughout at least two of said seat section channels and into interfitting engagement with the adjacent pedestals, said reinforcing bar means also being rigidly affixed to said horizontally extending bracket means.

18. The combination of claim 17, wherein said seating assembly further comprises integrally formed molded plastic backrest sections, said backrest sections being arranged end-to-end and interconnected by backrest section connectors in the form of integrally molded plastic pieces with oppositely facing congruent recesses into which fit adjacent backrest section ends, thereby forming a contiguous backrest section array, and wherein the end backrest section ends are each capped with an integral molded plastic end cap with a congruent recess which fits onto the backrest section end, and wherein each said backrest section is configured in its rear surface to have a longitudinally extending recessed channel, and a metal reinforcing bar extending throughout the length of said backrest recessed channel, the reinforcing bar and backrest section being rigidly supported above and behind said seat section by backrest mounting bracket means affixed to the horizontal surface of the gradine situated rearwardly of said seat section.

* * * * *